US006387188B1

(12) United States Patent
Laursen et al.

(10) Patent No.: US 6,387,188 B1
(45) Date of Patent: May 14, 2002

(54) PAD CONDITIONING FOR COPPER-BASED SEMICONDUCTOR WAFERS

(75) Inventors: Thomas Laursen, Tempe; Malcolm K. Grief, Chandler; Krishna P. Murella, Tempe; Sanjay Basak, Chandler, all of AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/261,868

(22) Filed: Mar. 3, 1999

(51) Int. Cl.[7] ..... B08B 3/04; B08B 3/08; C23G 1/02

(52) U.S. Cl. ..... 134/3; 134/2; 134/26; 134/28; 252/79.1; 252/79.4; 252/79.5

(58) Field of Search ..... 134/2, 3, 26, 28; 252/79.1, 79.4, 79.5

(56) References Cited

U.S. PATENT DOCUMENTS

| | | | | |
|---|---|---|---|---|
| 5,692,947 A | * | 12/1997 | Talieh et al. | 451/41 |
| 5,809,832 A | | 9/1998 | Gockel et al. | |
| 5,876,508 A | * | 3/1999 | Wu et al. | 134/2 |
| 5,934,980 A | * | 8/1999 | Koos et al. | 451/41 |
| 5,954,997 A | * | 9/1999 | Kaufman et al. | 252/79.1 |
| 6,162,301 A | * | 12/2000 | Zhang et al. | 134/3 |

FOREIGN PATENT DOCUMENTS

| | | |
|---|---|---|
| EP | 0696495 A1 | 2/1996 |
| EP | 0871214 A2 | 10/1998 |
| GB | 2324750 A | 11/1998 |
| WO | 98/36045 | 8/1998 |
| WO | WO 00/46842 | 8/2000 |

OTHER PUBLICATIONS

"Post CMP Clean–up", PTI Seminars, Inc., (1998), 1 pp.

"Hydrofluoric Acid", The University of Utah, www.ehs.utah.edu/ohh/hydrofl.htm (Oct. 2, 1997), 3 pp.

Zhong, Lei and Jerry Yang, "Impact of Slurry Particle Aggregation Upon Pad Surface Topography and Film Removal Rate in Chemical Mechanical Planarization," Electrochemical Society Proceedings, vol. 98–7, pp. 197–205, No date.

Laursen, Thomas and Malcolm Grief, "SeMa Tech 250 Wafer Copper CMP PDC Demonstration Report," Speed-Fam Corporation, (Jan. 1999), pp. 1–25.

* cited by examiner

*Primary Examiner*—Zeinab El-Arini
(74) *Attorney, Agent, or Firm*—Snell & Wilmer, L.L.P.

(57) ABSTRACT

A method of conditioning pads used in the polishing of semiconductor wafers containing copper circuitry. The method includes applying a treatment solution that contains a reactant for particulate copper-containing debris on the pad resulting from the copper circuitry. Preferably, the reactant is a carboxylic acid present in a concentration of from about 0.1 to about 10 weight percent in a solution. The pH of the solution may be adjusted to the range from about 1 to about 6 with a compatible base.

5 Claims, 1 Drawing Sheet

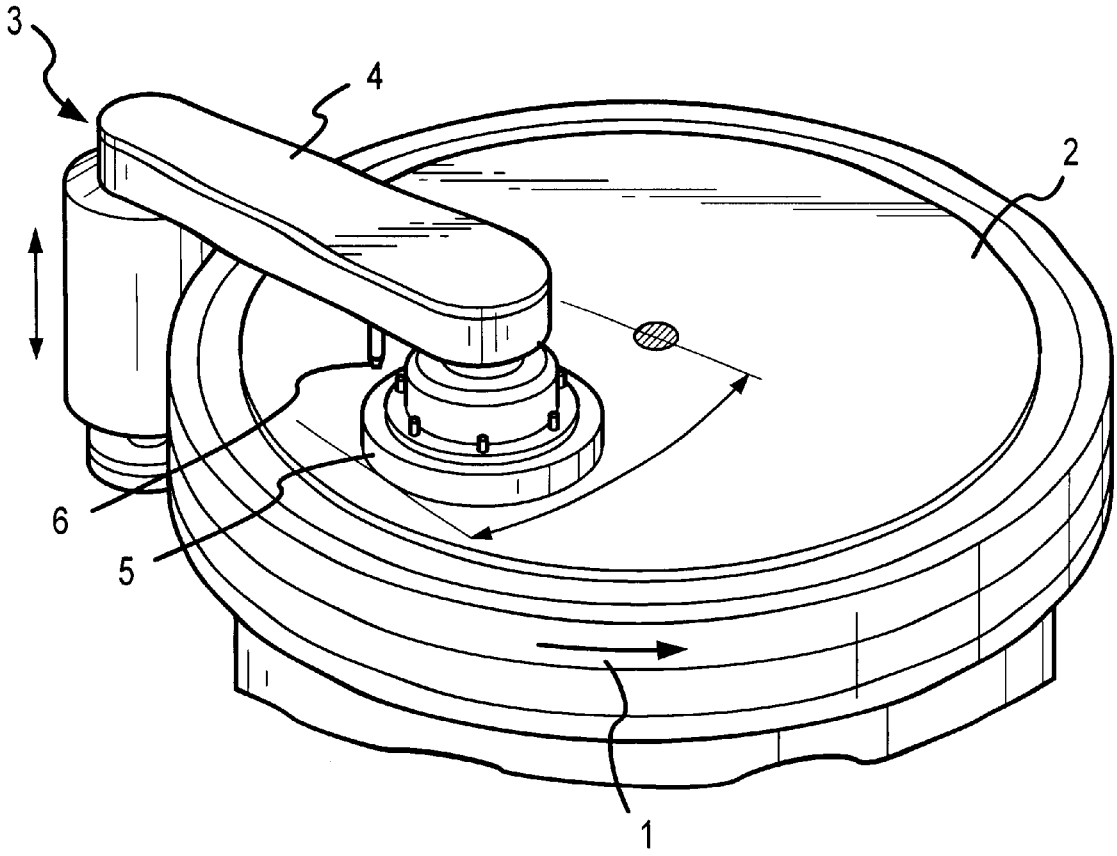
FIGURE

PAD CONDITIONING FOR COPPER-BASED SEMICONDUCTOR WAFERS

FIELD OF THE INVENTION

This invention relates to semiconductor wafer manufacture, and in particular to the step of polishing the wafer surface for planarization. The method of the invention is particularly applicable to wafers containing copper circuitry.

BACKGROUND OF THE INVENTION

During the fabrication of semiconductor wafers, it is common practice to polish the wafer surface at certain points in the process in order to maintain a planar surface. Maintaining such a surface is important because of the very fine detailed circuitry created on the wafer surface, in layers atop each other, and the requirements of the precision instruments used to create the layered circuitry.

In the past, the predominant, if not exclusive, metal used as the conductive component of semiconductors was aluminum. In more recent years, techniques have been developed to use copper, which offers the advantage of better electrical conductivity and the potential for significantly improved performance in several devices using semiconductors, particularly those utilizing a battery pack power supply that must be periodically recharged.

The newer copper technology has, however, presented additional challenges in the fabrication process. One of these relates to the fouling of polishing pads used to planarize the semiconductor wafer surfaces. While pads ordinarily must be conditioned periodically, even when aluminum is the conductive metal on the wafer, much more frequent reconditioning is required when copper is used. It has been found that polishing with standard chemical polishing aids produces a dark residue ("debris") that fouls pad surfaces, requiring more frequent pad conditioning, and ultimately more frequent pad replacement. More frequent pad conditioning reduces productivity, and more frequent pad replacement increases operating expenses. Therefore, there is a clear incentive to find ways to reduce the frequency of pad conditioning and pad replacement.

SUMMARY OF THE INVENTION

The invention provides a method of conditioning polishing pads used in the polishing of semiconductor wafers that comprise copper circuitry. The method includes treating the polishing surface of the pad with a treating solution that includes a reactant for copper debris formed on the pad. This treatment removes substantially all the copper debris, and is followed by a rinsing step, that in turn removes the treating solution so that the pad is free of reactants that might damage the next set of wafers to be polished.

In preferred embodiments, the reactant for copper debris is an acid, and more particularly a carboxylic acid such as oxalic acid, citric acid, malonic acid, succinic acid, lactic acid, and the like. Other acids able to react with copper residue are also useful. In accordance with the invention, it is also preferred to at least partially neutralize the acid to reduce the pH to the range from about 1.0 to about 6.0.

After cleaning the polishing pad with the treatment solution, the pad may be rinsed with standard pad conditioning solutions, and/or deionized water until the surface is substantially free of the treatment solution and suitable for reuse in the polishing of semiconductor wafers.

BRIEF DESCRIPTION OF THE DRAWINGS

The FIGURE is a schematic illustration showing a pad conditioner with an arm extending across the surface of a conditioning pad and a nozzle spraying treatment solution on the pad surfaces.

DETAILED DESCRIPTION OF THE PREFERRED EMBODIMENT

The invention provides a method of conditioning polishing pads used in the polishing of semiconductor wafers that include copper circuitry. These conditioning pads are subject to the accumulation of debris on polishing surfaces. The term "debris" as used in the specification and claims refers to a particulate residue produced when a semiconductor wafer containing copper circuitry is polished using a chemical polishing aid, such as the commercially available alumnina-containing Cabot 4110 polishing aid. Of course, other chemical polishing aids may also result in the production of this type of debris.

It is theorized, without being bound, that chemicals of the polishing aid react with the copper circuitry to produce copper oxides and hydroxides and that particulates of these reaction products form the debris which fouls the conditioning pad's surface.

In accordance with the method of the invention, polishing pads are conditioned by treating with a "reactive" for the debris. The term "reactant" as used in the specification and claims is not limited to a composition that forms ionic or covalent bonds with the debris, but rather includes all compositions that so modify the debris as to render it more easily removed from the pad during conditioning. Thus, the "reactant" includes for example, a solution containing ions of an acid, preferably a carboxylic acid. More preferably, the acid is selected from oxalic, citric, succinic, malonic, lactic, and like acids. The acid solution need not be particularly concentrated, and is preferably in the range from about 0.1 to about 10 weight percent carboxylic acid, more preferably from about 0.25 to about 1.0 weight percent. Even at these low concentrations, it may be expected that the pH of the solution would be low. Accordingly, the invention prefers the addition of a pH adjusting chemical to the solution, to achieve a pH in the range from about 1.0 to about 6.0, and preferably in the range from about 4 to about 5. The pH adjusting chemical may be selected from any of those that are compatible with the acid selected. For example, if oxalic acid is selected as the acid, then suitable and inexpensive pH adjustment additives include the alkali metal hydroxides such as sodium hydroxide and potassium hydroxide. The use of compatible but basic chemicals with cations that do not precipitate the selected acid, but retain the anions of the acidic moiety in solution, are preferred.

The treatment solution may be applied to the condition pad in any one of a variety of ways. For example, the treatment solution may be sprayed onto the pad through a high pressure nozzle, and the spraying may be accompanied by gentle brushing of the pad surface to facilitate debris removal. Alternatively, the pad may be soaked in the treatment solution.

After the pad has been cleaned with the treatment solution, it is essential to remove substantially all of the treatment chemicals from the polishing surface of the pad. This can be achieved in a variety of ways. In accordance with the invention, it is preferred to rinse the pad surface with deionized water, or standard pad conditioning solutions until the treatment chemicals have been substantially completely flushed from the pad. This may be checked by testing the pH of rinse solution coming off the pad and by visual inspection. Clearly, the time periods for treating and rinsing can be predetermined and automated based on a treatment protocol established from several test runs.

Existing pad conditioning apparatus may easily be modified to carry out the method of the invention. For example, the figure shows an exemplary pad conditioning apparatus that includes a polishing platen 1, to which is mounted a polishing pad 2 undergoing conditioning using pad conditioner 3. Conditioner 3 includes a pad conditioning arm 4 that extends across the surface of the polishing pad, so that pad conditioning ring 5 at the far end of the arm 4 is in contact with the pad 2. A tube carrying pad cleaning solution (not shown) supplied through a pump (not shown) is attached to the conditioning arm 4 and has a nozzle 6 at its tip directed downward toward the polishing pad 2, preferably to a position near the pad conditioning ring 5 to facilitate cleaning.

The above description of the preferred embodiments does not limit the scope of the invention, which is encompassed by the appended claims. The invention includes the subject matter disclosed, and equivalent steps and structures, including those known to those with skill in the art to be interchangeable with the steps and structures disclosed.

What is claimed is:

1. A method of removing copper debris from a polishing surface of a polishing pad used in the polishing of semiconductor wafers comprising copper circuitry, the method comprising:

(a) selecting the pad after the pad has been used to polish semiconductor wafers comprising copper circuitry and a polishing surface of said pad includes copper debris from the copper circuitry;

(b) treating the polishing surface of the pad with a treatment composition consisting essentially of a reactant selected from oxalic acid, succinic acid, lactic acid, malonic acid and citric acid;

(c) reacting the copper debris with the reactant; and (d) after the treating, rinsing the surface of the pad to remove substantially all of the reactant.

2. The method of claim 1, wherein a pH of the treatment composition is in the range from about 1.0 to about 6.0.

3. The method of claim 1, wherein the treatment composition has a pH in the range from about 4 to about 5.

4. The method of claim 1, wherein the treatment composition comprised about 0.25 to about 1.0 weight percent of an acid.

5. A method of removing copper debris from a polishing surface of a polishing pad used in the polishing of semiconductor wafers comprising copper circuitry, the method comprising:

(a) selecting the pad after the pad has been used to polish semiconductor wafers comprising copper circuitry and a polishing surface of said pad includes copper debris from the copper circuitry;

(b) reacting the copper debris on the polishing surface of the pad with a treatment solution consisting essentially of a reactant selected from oxalic acid, citric acid, succinic acid, lactic acid and malonic acid, the solution having a pH in the range about 4 to about 5; and (c) rinsing the surface of the pad to remove substantially all of the treatment solution.

* * * * *